US008668297B2

(12) United States Patent
Kim

(10) Patent No.: US 8,668,297 B2
(45) Date of Patent: Mar. 11, 2014

(54) DRIVER FOR INKJET HEAD

(75) Inventor: Byung Hun Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 218 days.

(21) Appl. No.: 13/358,115

(22) Filed: Jan. 25, 2012

(65) Prior Publication Data

US 2013/0106933 A1 May 2, 2013

(30) Foreign Application Priority Data

Nov. 2, 2011 (KR) ..... 10-2011-0113357

(51) Int. Cl.
*B41J 29/38* (2006.01)

(52) U.S. Cl.
USPC ..... 347/10; 347/50; 347/57

(58) Field of Classification Search
USPC ..... 347/5, 9, 10, 12, 14, 19, 40, 50, 57–58
See application file for complete search history.

(56) References Cited

U.S. PATENT DOCUMENTS 7,300,126 B2 * 11/2007 Uraki et al. ..... 347/10
7,441,853 B2 * 10/2008 Takata ..... 347/14
8,075,076 B2 * 12/2011 Ootsuka ..... 347/9

FOREIGN PATENT DOCUMENTS

JP 2005-319707 11/2005
JP 2009-178616 8/2009

* cited by examiner

*Primary Examiner* — Juanita D Jackson

(57) ABSTRACT

There is provided a driver for an inkjet head, capable of smoothly driving the inkjet head. The driver for an inkjet head includes: an amplifying unit having a plurality of amplifiers individually outputting signals having voltage levels amplified in accordance with a predetermined gain in a predetermined cycle; a coupling unit coupling the signals outputted from the plurality of amplifiers as a single driving signal in accordance with a control signal; a controlling unit controlling the coupling of signals performed by the coupling unit; and a switching unit switching a signal transmission path through which the single driving signal is transmitted to an inkjet head.

10 Claims, 6 Drawing Sheets

DRIVER FOR INKJET HEAD

CROSS-REFERENCE TO RELATED APPLICATIONS

This application claims the priority of Korean Patent Application No. 10-2011-0113357 filed on Nov. 2, 2011, in the Korean Intellectual Property Office, the disclosure of which is incorporated herein by reference.

BACKGROUND OF THE INVENTION

1. Field of the Invention

The present invention relates to a driver for an inkjet head, and more particularly, to a driver for an inkjet head capable of smoothly driving a piezoelectric inkjet head.

2. Description of the Related Art

In recent years, a piezoelectric inkjet head has been used in an industrial inkjet printer.

For example, a piezoelectric inkjet head may be used in directly forming a circuit pattern by spraying ink, made by melting a metal such as gold, silver, or the like, onto a printed circuit board (PCB), or may be used in manufacturing industrial graphics, a liquid crystal display (LCD), an organic light emitting diode (OLED), a solar cell, or the like.

The piezoelectric inkjet head may include a pressure chamber, a nozzle, a flow channel, and a piezo-actuator generating driving pressure.

In general, the piezo-actuator is closely attached and bonded to the vicinity of the pressure chamber, and pressure may be transferred to the pressure chamber by a change in displacement of the piezo-actuator having an electric signal applied thereto to thereby allow droplets of ink to be ejected from the nozzle.

The electrical signal transferred for the change in displacement of the piezo-actuator has a voltage driving waveform and a driver is used to generate the voltage driving waveform.

Usually, the driver includes a single driver circuit to drive the inkjet head, approximately 10 to 1000 nozzles per inkjet head are provided, and the piezo-actuator is adopted for each nozzle. Thus, when the number of nozzles or an ejection frequency increases, electrical power of the driver increases, and as a result, the inkjet head may not easily driven with a single driver circuit, or a relatively expensive driver circuit having a complicated circuit pattern needs to be adopted.

SUMMARY OF THE INVENTION

An aspect of the present invention provides a driver for an inkjet head, capable of operating smoothly even at a low amplifier operating frequency by employing a plurality of amplifiers and a coupler coupling amplified signals in order to generate a single driving signal.

According to an aspect of the present invention, there is provided a driver for an inkjet head, including: an amplifying unit having a plurality of amplifiers individually outputting signals having voltage levels amplified in accordance with a predetermined gain in a predetermined cycle; a coupling unit coupling the signals outputted from the plurality of amplifiers as a single driving signal in accordance with a control signal; a controlling unit controlling the coupling of signals performed by the coupling unit; and a switching unit switching a signal transmission path through which the single driving signal is transmitted to an inkjet head.

The driver for an inkjet head may further include a converter having a plurality of digital-analog converters (DACs) converting digital signals into analog signals to provide the analog signals to the plurality of respective amplifiers.

The switching unit may be provided between the coupling unit and the inkjet head to switch the signal transmission path of the single driving signal.

The switching unit may be provided between the inkjet head and a ground to switch the signal transmission path of the single driving signal.

The plurality of amplifiers may have the same gain.

The plurality of amplifiers may have the same gain.

The plurality of amplifiers may have different gains.

The single driving signal may include main high-level signals having predetermined voltage levels and sub high-level signals having voltage levels lower than those of the main high-level signals.

The plurality of amplifiers may individually provide the high-level signals at a frequency in the range of 1 KHz to 10 KHz.

The single driving signal may have the main high-level signals having predetermined voltage levels and a frequency in the range of 30 KHz to 50 KHz.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Embodiments of the present invention will now be described in detail with reference to the accompanying drawings.

Figure 1:
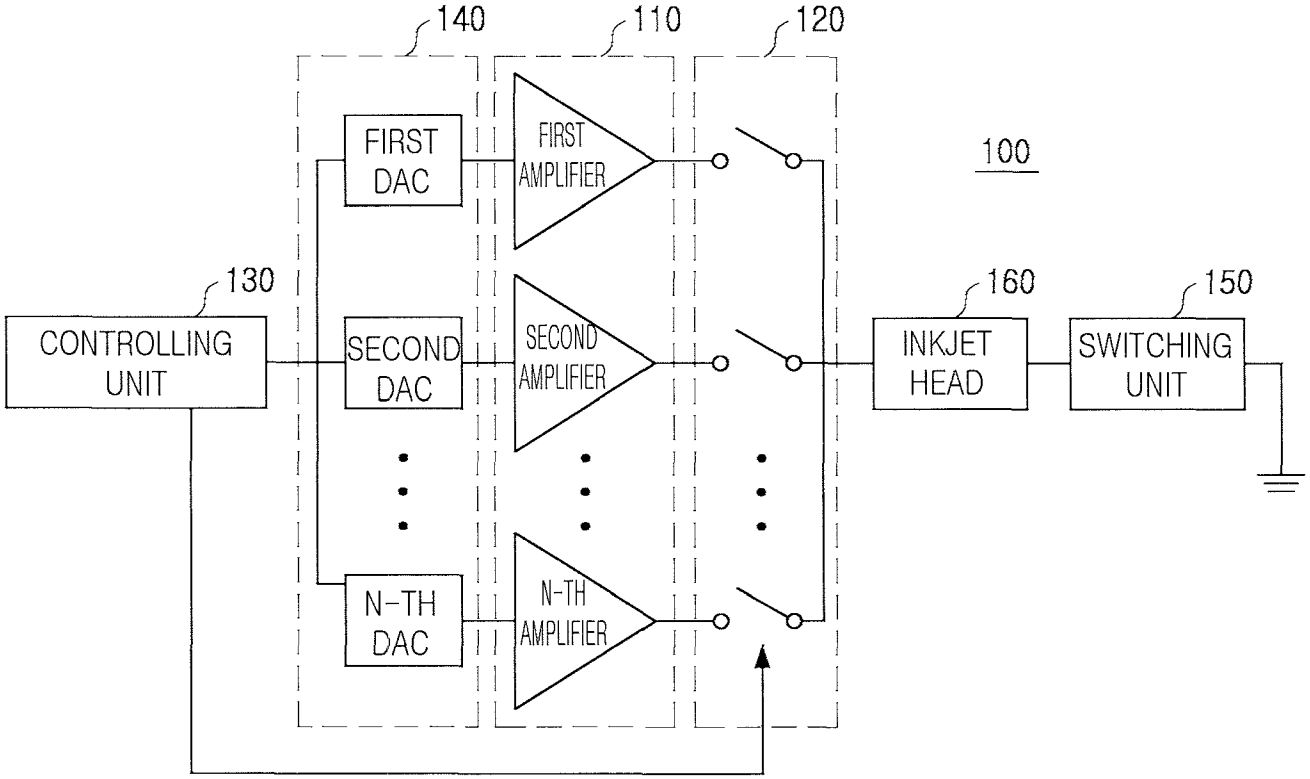
FIG. 1 is a configuration diagram of a driver for an inkjet head according to an embodiment of the present invention.

FIG. 1 is a configuration diagram of a driver for an inkjet head according to an embodiment of the present invention.

Referring to FIG. 1, a driver 100 for an inkjet head according to an embodiment of the present invention may include an amplifying unit 110, a coupling unit 120, a controlling unit 130, and a switching unit 150 and further include a converter 140.

The amplifying unit 110 may include a plurality of first to n (n is a natural number) amplifiers and the first to n-th amplifiers may individually amplify input signals by predetermined gains.

The coupling unit 120 couples the amplified signals of the first to n-th amplifiers of the amplifying unit 110 as a single driving signal to drive an inkjet head 160.

The controlling unit 130 may provide the input signals to the amplifying unit 110 and control switching of a coupling path to couple the amplified signals as the driving signal in the coupling unit 120.

The switching unit 150 may switch a signal transmission path so as to transmit the driving signal to a plurality of piezo-heads provided with respect to a plurality of nozzles of the inkjet head 160.

As shown in FIG. 1, in the driver 100 for an inkjet head according to the embodiment of the present invention, the switching unit 150 may be configured in a low side switching scheme, in which the switching unit 150 is connected between the inkjet head 160 and a ground.

Furthermore, the driver 100 for an inkjet head according to the embodiment of the present invention may further include the converter 140.

The converter 140 may include a plurality of first to n-th digital-analog converters (DACs) and convert digital signals from the controlling unit 130 into analog signals to provide the analog signals to the plurality of respective amplifiers of the amplifying unit 110.

Figure 2:
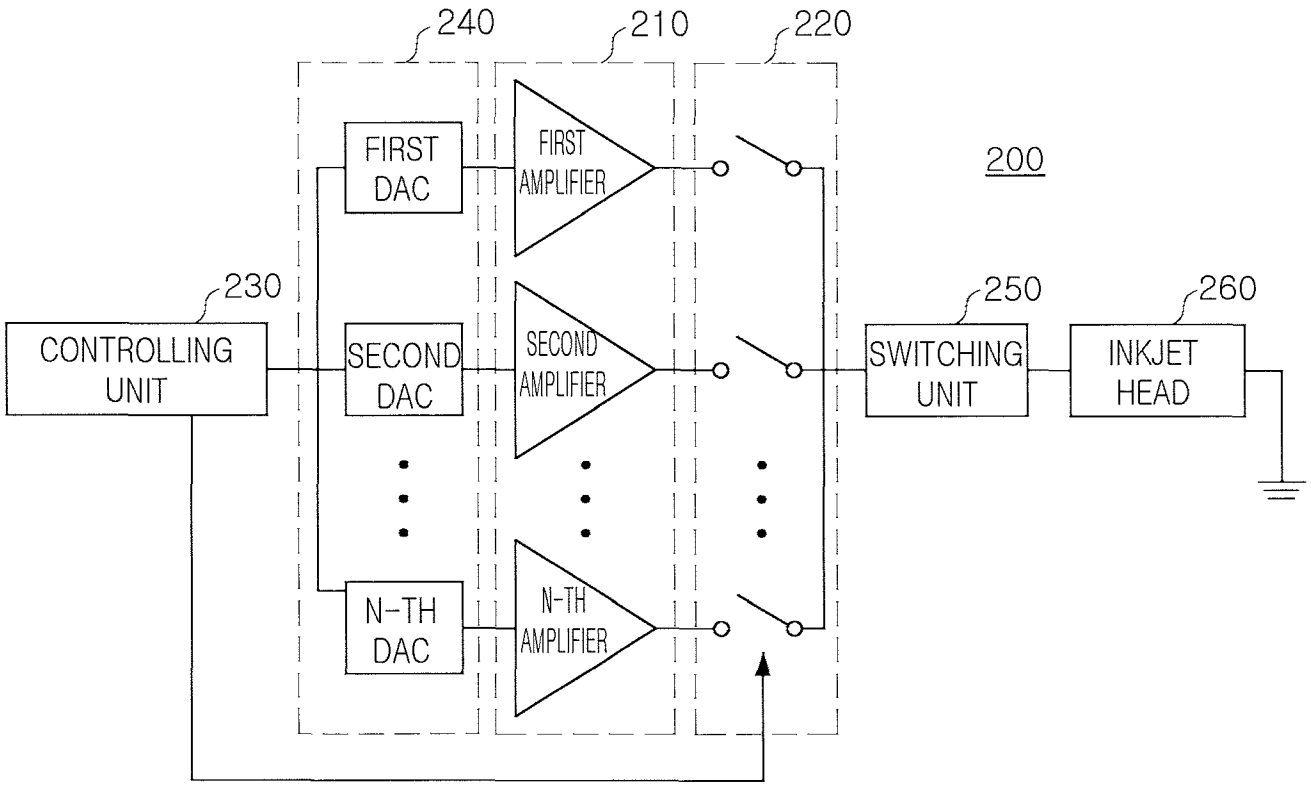
FIG. 2 is a configuration diagram of a driver for an inkjet head according to another embodiment of the present invention.

FIG. 2 is a configuration diagram of a driver for an inkjet head according to another embodiment of the present invention.

Referring to FIG. 2 together with FIG. 1, since an amplifying unit 210, a coupling unit 220, a controlling unit 230, a converter 240, and a switching unit 250 in a driver 200 for an inkjet head according to another embodiment of the present invention have the same functions as those of the amplifying unit 110, the coupling unit 120, the controlling unit 130, the converter 140, and the switching unit 150 in the driver 100 for an inkjet head according to the embodiment of the present invention shown in FIG. 1, a detailed description thereof will be omitted.

However, in the driver 200 for an inkjet head according to another embodiment of the present invention, the switching unit 250 may be configured in a high side switching scheme, in which the switching unit 250 is connected between an inkjet head 260 and the coupling unit 220.

As described above, the driver 200 for an inkjet head according to another embodiment of the present invention has the same basic operation as the driver 100 for an inkjet head according to the embodiment of the present invention, except for different switching schemes. Therefore, the present invention will now be described based on the driver 100 for an inkjet head according to the embodiment of the present invention shown in FIG. 1.

Figure 3:
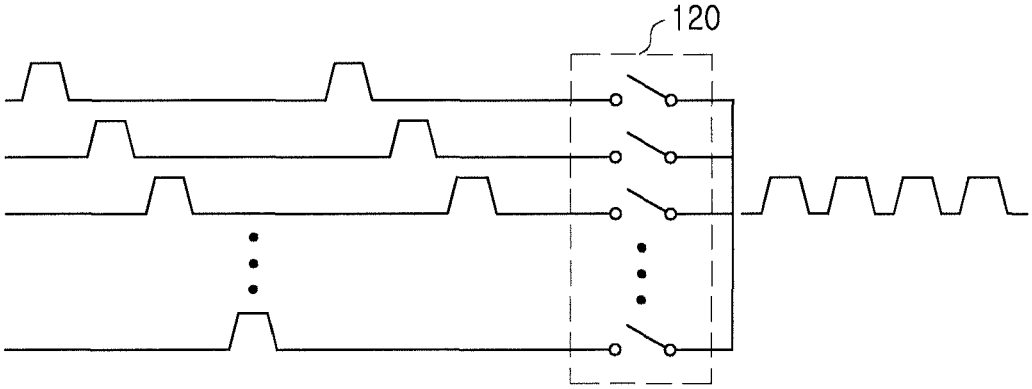
FIG. 3 is a diagram showing a principle of generating a driving waveform of the driver for an inkjet head according to the embodiment of the present invention.

FIG. 3 is a diagram showing a principle of generating a driving waveform of the driver for an inkjet head according to the embodiment of the present invention.

Referring to FIG. 1 together with FIG. 3, the first to n-th amplifiers may individually amplify input signals from the controlling unit 130 according to predetermined gains.

As a result, the first to n-th amplifiers may individually output high-level signals having a voltage level capable of driving the inkjet head for a predetermined period of time.

In this case, the first to n-th amplifiers may individually output the high-level signals at different timings and the coupling unit 120 may include a plurality of switches.

As a result, the plurality of switches of the coupling unit 120 are switched on in accordance with a control signal of the controlling unit 130 to couple the high-level signals outputted at different timings as the single driving signal and transmit the driving signal to the inkjet head 160, thereby driving a piezo-actuator of the inkjet head 160.

Figure 4:
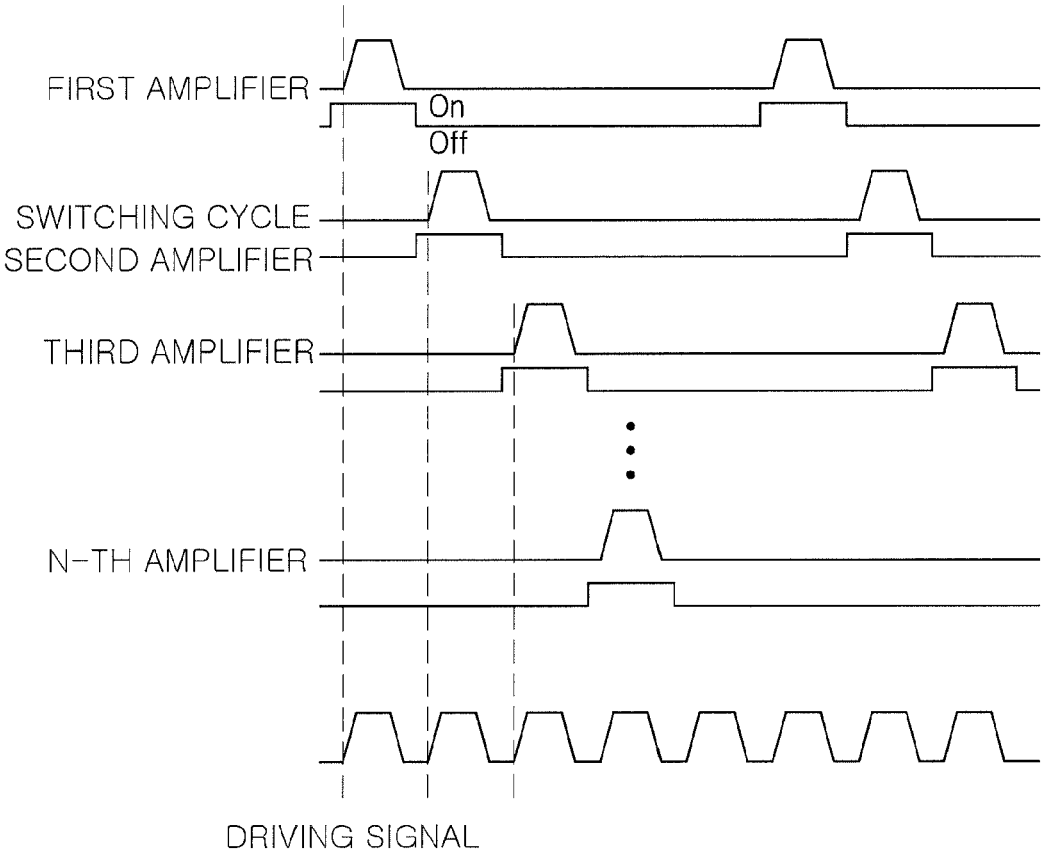
FIG. 4 is a timing diagram of the driving waveform of the driver for an inkjet head according to the embodiment of the present invention.

FIG. 4 is a timing diagram of the driving waveform of the driver for an inkjet head according to the embodiment of the present invention.

Referring to FIGS. 1 and 3 together with FIG. 4, the first to n-th amplifiers of the amplifying unit 110 in the driver 100 for an inkjet head according to the embodiment of the present invention may individually output the high-level signals for a predetermined period of time in a predetermined cycle. The amplifiers may output low-level signals for a period of time, other than the predetermined period of time.

The plurality of switches of the coupling unit 120 are switched on at the times when the first to n-th amplifiers individually output the high-level signals according to the control operation of the controlling unit 130 to allow the high-level signals of the first to n-th amplifiers to be outputted through the coupling unit 120, thereby allowing the single driving signal to be outputted.

That is, in the driver for an inkjet head according to the embodiment of the present invention, since the plurality of amplifiers and the coupler coupling the amplified signals are employed to set a driving signal frequency to be high even at a low operating frequency of the amplifier, the inkjet head may be driven at a desired speed and further, the amplifiers operate at a lower operating frequency as compared to the driving signal frequency set to be high to thereby reduce power consumption. In addition, since the amplifiers operate at a low operating frequency, heat emission of the amplifiers may be reduced.

Figure 5:
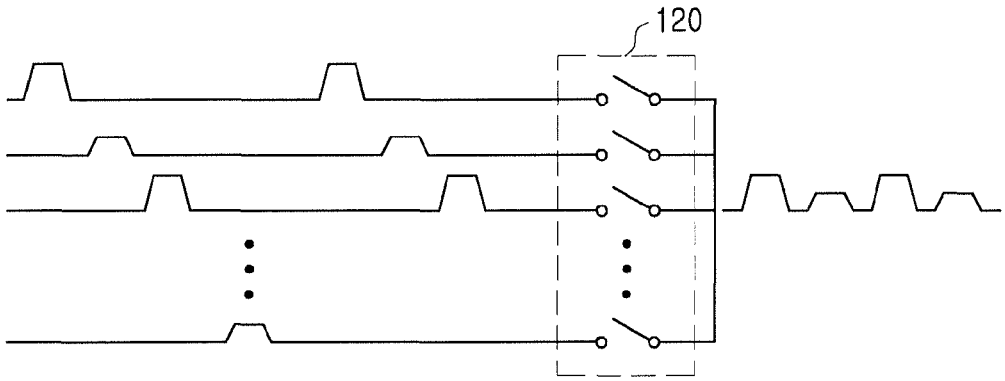
FIG. 5 is a diagram showing a principle of generating a driving waveform including a sub-waveform of the driver for an inkjet head according to the embodiment of the present invention.

FIG. 5 is a diagram showing a principle of generating a driving waveform including a sub-waveform of the driver for an inkjet head according to the embodiment of the present invention.

Referring to FIG. 5 together with FIG. 1, the first to n-th amplifiers of the amplifying unit 110 may have the predetermined gains and may be set to have different gains.

Accordingly, the high-level signals of the first to n-th amplifiers may be divided into main high-level and sub high-level signals. A voltage level of the main high-level signal may be higher than those of the sub high-level signal.

When voltage levels of the high-level signals are high, in a case in which the high-level signals are coupled as the driving signal to be transmitted to the inkjet head 160, displacement force of the piezo-actuator may be increased.

Figure 6:
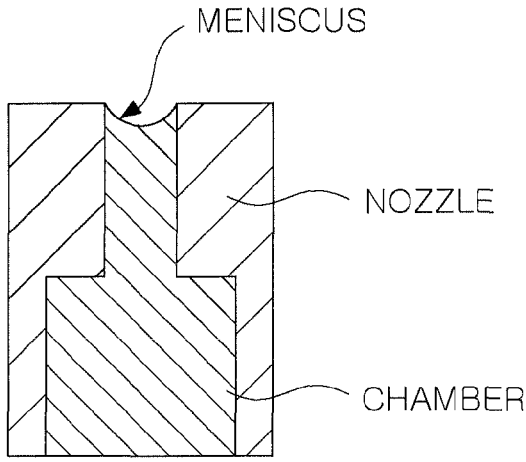
FIG. 6 is a configuration diagram of a nozzle of the driver for an inkjet head according to the embodiment of the present invention.

FIG. 6 is a configuration diagram of a nozzle of the driver for an inkjet head according to the embodiment of the present invention.

Referring to FIG. 6, the inkjet head includes a plurality of nozzles, the piezo-actuator is provided with respect to each of the plurality of nozzles, pressure is applied to a chamber inside each nozzle according to the displacement of the piezo-actuator, and ink contained in the chamber is ejected when the pressure is applied to the chamber.

The driver for an inkjet head provides the driving signal to drive the piezo-actuator of the inkjet head, and a surface of the nozzle at the ink and air interface is called a meniscus. When the meniscus moves forward and backward in the nozzle due to the large surface thereof after liquid droplets of ink to be ejected are formed, air bubbles may be drawn into the chamber or ejection may be unstably performed at the subsequent inkjet ejection. As a result, when the piezo-actuator is driven by forming the sub high-level signal at the next timing of the main high-level signal, the meniscus may move stably.

Figure 7:
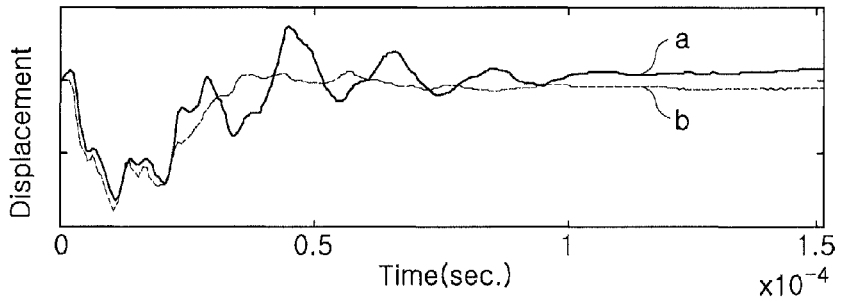
FIG. 7 is a graph showing a vibration characteristic of a piezo-actuator by the driving waveform including the sub-waveform.

FIG. 7 is a graph showing a vibration characteristic of a piezo-actuator by the driving waveform including the sub-waveform.

Referring to FIG. 7, in the graph showing the vibration characteristic of the piezo-actuator, reference numeral "a" represents the vibration characteristic of the piezo-actuator when the driving signal has no sub high-level signal and reference numeral "b" represents the vibration characteristic of the piezo-actuator when the driving signal has the sub high-level signal.

As shown in FIG. 7, droplet ejection is terminated at approximately 40 microseconds (uses) and thereafter, the piezo-actuator is vibrated due to residual pressure which remains in the chamber. When the driving signal has no high-level signal, the piezo-actuator is significantly vibrated after ejection, while when the driving signal has the sub high-level signal, the vibration is remarkably reduced.

As described above, the driving signal is generated to form the sub high-level signal at the next timing of the main high-level signal, such that, when residual vibrations are significant, a phenomenon in which the meniscus unnecessarily moves forward and backward in the nozzle to cause unstable subsequent ejection, thereby occurring the abnormal ejection of droplets, or a phenomenon in which air bubbles easily flow into the nozzle to stop the ejection, may be prevented.

Figure 8:
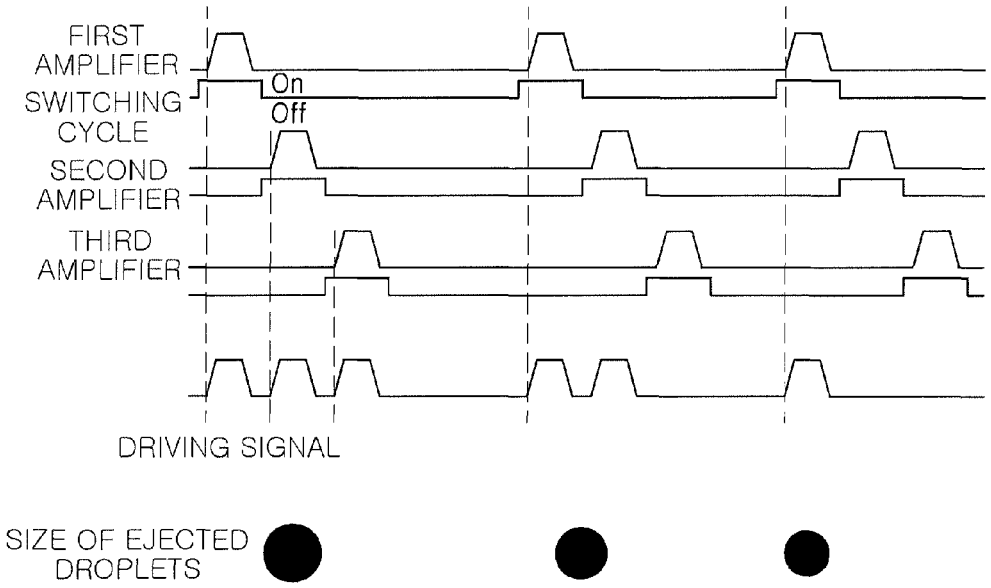
FIG. 8 is a timing diagram of the driving waveform for forming a gray scale of the driver for an inkjet head according to the embodiment of the present invention.

FIG. 8 is a timing diagram of the driving waveform for forming a gray scale of the driver for an inkjet head according to the embodiment of the present invention.

Referring to FIG. 1 together with FIG. 8, the first to n-th amplifiers of the amplifying unit 110 in the driver for an inkjet head according to the embodiment of the present invention individually output the high-level signals for a predetermined period of time. The frequency to determine a cycle in which the high-level signals are outputted may be approximately in the range of 1 KHz to 10 KHz.

In this case, the controlling unit 130 may control the plurality of switches of the coupling unit 120 in such a manner that the switches are turned on in accordance with the timings at which the high-level signals of the first to n-th amplifiers are individually outputted. As the plurality of high-level signals are in succession, the size of the droplets ejected from the nozzle may be increased, and as a result, the gray scale may be adjusted.

As the gray scale is controlled, the frequency to determine a cycle of a high-level signal group having the high-level signals which are in succession so as to adjust the gray scale may be approximately in the range of 30 KHz to 50 KHz.

As described above, according to the embodiment of the present invention, the driver for an inkjet head may smoothly operate even at the low operating frequency of the amplifier by employing the plurality of amplifiers and the coupler coupling amplified signals in order to generate the single driving signal to thereby reduce power consumption. Further, since the single driving signal is generated by using the plurality of amplifiers, the driver for an inkjet head may operate smoothly even at a high operating frequency.

Moreover, the ejection operation may be stably performed at the time of droplet ejection by the sub high-level signal and the gray scale may be adjusted by controlling the size of the droplets by adjusting the number of the main high-level signals of the driving signal.

As set forth above, according to embodiments of the present invention, there is provided a driver for an inkjet head capable of smoothly operating even at a low operating frequency of an amplifier by employing a plurality of amplifiers and a coupling unit coupling amplified signals in order to generate a single driving signal to thereby reduce power consumption.

While the present invention has been shown and described in connection with the embodiments, it will be apparent to those skilled in the art that modifications and variations can be made without departing from the spirit and scope of the invention as defined by the appended claims.

What is claimed is:

1. A driver for an inkjet head, comprising:

an amplifying unit having a plurality of amplifiers individually outputting signals having voltage levels amplified in accordance with a predetermined gain in a predetermined cycle;

a coupling unit coupling the signals outputted from the plurality of amplifiers as a single driving signal in accordance with a control signal;

a controlling unit controlling the coupling of signals performed by the coupling unit; and a switching unit switching a signal transmission path through which the single driving signal is transmitted to the inkjet head.

2. The driver for an inkjet head of claim 1, further comprising a converter having a plurality of digital-analog converters (DACs) converting digital signals into analog signals to provide the analog signals to the plurality of respective amplifiers.

3. The driver for an inkjet head of claim 1, wherein the switching unit is provided between the coupling unit and the inkjet head to switch the signal transmission path of the single driving signal.

4. The driver for an inkjet head of claim 1, wherein the switching unit is provided between the inkjet head and a ground to switch the signal transmission path of the single driving signal.

5. The driver for an inkjet head of claim 1, wherein the plurality of amplifiers individually provide high-level signals for a predetermined period of time in the predetermined cycle.

6. The driver for an inkjet head of claim 5, wherein the plurality of amplifiers have the same gain.

7. The driver for an inkjet head of claim 6, wherein the plurality of amplifiers individually provide the high-level signals at a frequency in the range of 1 KHz to 10 KHz.

8. The driver for an inkjet head of claim 5, wherein the plurality of amplifiers have different gains.

9. The driver for an inkjet head of claim 8, wherein the single driving signal includes main high-level signals having predetermined voltage levels and sub high-level signals having voltage levels lower than those of the main high-level signals.

10. The driver for an inkjet head of claim 9, wherein the single driving signal has the main high-level signals having predetermined voltage levels and a frequency in the range of 30 KHz to 50 KHz.

* * * * *